United States Patent [19]

Coll-Palagos et al.

[11] 4,246,320

[45] Jan. 20, 1981

[54] PLATED ACRYLATE/STYRENE/ACRYLONITRILE ARTICLE

[75] Inventors: Miguel Coll-Palagos, Rye, N.Y.; Frank O. Groch, Kelseyville, Calif.; Paul Kraft, South Spring Valley; Ruey Y. Lin, New City, both of N.Y.

[73] Assignee: Stauffer Chemical Company, Westport, Conn.

[21] Appl. No.: 20,678

[22] Filed: Mar. 15, 1979

[51] Int. Cl.[3] ..... B32B 15/08; B32B 27/30

[52] U.S. Cl. ..... 428/463; 427/306; 427/347; 427/357; 427/367; 427/404; 427/443.1; 428/522

[58] Field of Search ..... 428/461, 463, 522; 427/367, 404, 430 A, 347, 357, 306

[56] References Cited

U.S. PATENT DOCUMENTS

| | | | |
|---|---|---|---|
| 3,370,974 | 2/1968 | Hepfer | 427/306 |
| 3,423,226 | 1/1969 | Jensen | 427/306 |
| 3,437,507 | 4/1969 | Jensen | 427/306 |
| 3,547,785 | 12/1970 | Sakuma | 204/30 |
| 3,563,783 | 2/1971 | Sukuma | 428/461 |
| 3,620,804 | 11/1971 | Bauer et al. | 204/30 X |
| 3,622,370 | 11/1971 | D'Ottavio et al. | 204/30 |
| 3,632,704 | 1/1972 | Palagos | 264/49 |
| 3,650,911 | 3/1972 | Lin | 427/404 X |
| 3,652,478 | 3/1972 | Ishii et al. | 428/461 X |
| 3,667,972 | 6/1972 | Palagos | 106/1 |
| 3,671,274 | 6/1972 | Maekawa et al. | 106/1 |
| 3,677,792 | 7/1972 | Best | 427/404 X |
| 3,764,487 | 10/1973 | Yamamoto et al. | 204/15 |
| 3,790,400 | 2/1974 | Kuzmik | 106/1 |
| 3,849,172 | 11/1974 | Chin et al. | 428/463 X |
| 3,944,631 | 3/1976 | Yu et al. | 260/881 |
| 3,962,497 | 6/1976 | Doty et al. | 427/306 |
| 4,049,859 | 9/1977 | Yoshikawa et al. | 428/461 X |
| 4,077,853 | 3/1978 | Palagos | 204/20 |
| 4,098,922 | 7/1978 | Dinella et al. | 427/54 |
| 4,164,488 | 8/1979 | Gregorovich et al. | 428/463 X |
| 4,164,587 | 8/1979 | Borman | 428/461 X |
| 4,169,180 | 9/1979 | McDonagh | 428/522 X |

OTHER PUBLICATIONS

Modern Electroplating, F. A. Larvenheim, Ed. John Wiley & Sons, Inc., New York, 1974, pp. 640 & 641.

"The ABC's of Electroplating", N. Amis, Plastics Engineering, Jan. 1977, pp. 14–17.

"Electroless Plating of Plastics", G. A. Krulik, Journal of Chem. Educ., vol. 55, No. 6, Jun. 1978, pp. 361–365.

*Primary Examiner*—Harold Ansher

*Attorney, Agent, or Firm*—Richard P. Fennelly

[57] ABSTRACT

An article comprising: (1) an interpolymer which comprises crosslinked (meth)acrylate, crosslinked styrene-acrylonitrile, and uncrosslinked styrene-acrylonitrile components; and (2) an adherent metallic coating on said interpolymer. The article is useful as a plated component in motor vehicles, for example, as trim, grille work, wheel covers, and the like, or as plated appliance parts or plumbing components.

5 Claims, No Drawings

PLATED ACRYLATE/STYRENE/ACRYLONITRILE ARTICLE

BACKGROUND OF THE INVENTION

1. Field of the Invention

The present invention is an article which is a plated meth(acrylate)/styrene/acrylonitrile interpolymer. It is useful as a plated component in motor vehicles, appliances and plumbing systems.

2. Description of the Prior Art

The interpolymer which forms the substrate for the article of the present invention is known and is described in U.S. Pat. No. 3,944,631 to A. J. Yu et al. as an impact resistant and weatherable thermoplastic composition. This prior art patent describes its use per se as a substitute for acrylonitrile-butadiene-styrene (ABS) resins but does not show or suggest that such an interpolymer can be plated.

The prior art teaches that ABS resins are platable because of the presence of the oxidizable butadiene component contained therein (see, for example, U.S. Pat. No. 3,764,487 to H. Yamamoto et al., Col. 1, line 61 to Col. 2, line 20; Modern Electroplating, F. A. Lowenheim, ed., Third Edition, John Wiley and Sons, Inc., New York, N.Y., p. 640; "The ABC's of Electroplating ABS" by N. Anis, Plastics Engineering, pp. 14–17, January 1977; and "Electroless Plating of Plastics", by G. A. Krulik, J. of Chem. Educ., Vol. 55, No. 6, pp. 361–365, June, 1978).

SUMMARY OF THE PRESENT INVENTION

The present invention is a plated article comprising: (1) an interpolymer comprising crosslinked (meth)acrylate, crosslinked styrene-acrylonitrile, and uncrosslinked styrene-acrylonitrile components; and (2) an adherent metallic coating on said interpolymer. Even though the substrate interpolymer used in the article of the present invention fails to contain an oxidizable butadiene component, it is nevertheless platable using conventional plating procedures.

DESCRIPTION OF PREFERRED EMBODIMENTS OF THE PRESENT INVENTION

The terminology "interpolymer comprising crosslinked (meth)acrylate, crosslinked styrene-acrylonitrile, and uncrosslinked styrene-acrylonitrile components" as used herein is meant to encompass the type of interpolymer compositions described and claimed in U.S. Pat. No. 3,944,631 to A. J. Yu et al. These interpolymer compositions are formed by a three-step, sequential polymerization process, as follows: 1. emulsion polymerizing a monomer charge (herein designated "(meth-)acrylate", for purposes of the present invention), of at least one $C_2$–$C_{10}$ alkyl acrylate, $C_8$–$C_{22}$ alkyl methacrylate, or compatible mixture thereof, in an aqueous polymerization medium in the presence of an effective amount of a suitable di- or polyethylenically unsaturated crosslinking agent for such a monomer, with the $C_4$–$C_8$ alkyl acrylates being the preferred (meth)acrylate monomers for use in this step;

2. emulsion polymerizing a monomer charge of styrene and acrylonitrile in an aqueous polymerization medium, also in the presence of an effective amount of a suitable di- or polyethylenically unsaturated crosslinking agent for such a monomer, said polymerization being carried out in the presence of the product from Step 1 so that the crosslinked (meth)acrylate and crosslinked styrene-acrylonitrile components form an interpolymer wherein the respective phases surround and/or penetrate one another; and 3. either emulsion of suspension polymerizing a monomer charge of styrene and acrylonitrile, in the absence of a crosslinking agent, in the presence of the product resulting from Step 2 to form the final interpolymer composition. If desired, Steps 1 and 2 can be reversed in the above-described procedure.

This product comprises from about 5% to about 50%, by weight, of at least one of the above-identified crosslinked (meth)acrylate components, from about 5% to about 35%, by weight, of the crosslinked styrene-acrylonitrile component, and from about 15% to about 90%, by weight, of the uncrosslinked styrene-acrylonitrile component. It contains little graft polymerization between the styrene-acrylonitrile copolymer components and the crosslinked (meth)acrylate polymeric component, and it has an optimum processing range of from about 199° C. to about 232.2° C. due to the presence of potentially varying amounts of three differing polymer phases in the composition. Further details regarding this type of polymer composition can be found in U.S. Pat. No. 3,944,631 to A. J. Yu et al., which is incorporated herein by reference.

In order to further enhance the plating characteristics of the interpolymer substrate (for example, by increasing the adhesion of the metal coating to the polymer substrate as indicated by increased peel adhesion), it is generally necessary to incorporate an effective amount (for example, from about 1% to about 30%, by weight of the interpolymer) of one or more finely divided filler materials to achieve such an effect. Examples of suitable filler materials are titanium dioxide, talc, mica, calcium carbonate, and carbon black. The unfilled interpolymer is plateable, but fillers can be added to reduce, for example, the cost of the substrate, and to improve the plateability characteristics of the interpolymer. Any desired filler can be treated with a small amount (for example, from about 0.5% to about 10%, by weight of the filler) of a suitable coupling agent to improve its compatibility with the interpolymer substrate. Representative coupling agents include the silane coupling agents. A representative prior art patent which discusses the role that fillers can perform is U.S. Pat. No. 3,632,704 to M. Coll-Palagos.

The interpolymer substrate can also contain the type of interpolymer impact modifier described in U.S. Pat. No. 3,969,431 to R. E. Gallagher in order to enhance the impact resistance of the final article, especially if fillers are also present. This type of interpolymer is formed by first forming a crosslinked acrylate component (for example, containing a butyl acrylate/2-ethylhexyl acrylate mixture) by emulsion polymerization and then suspension polymerizing vinyl chloride monomer in the presence of the previously formed crosslinked acrylate component. Further details regarding this type of interpolymer and of the process for forming it can be found in the abovementioned U.S. patent which is also incorporated herein by reference.

The interpolymer substrate of the article of the present invention is formed into the desired shape that the plated article is to possess by such conventional forming techniques as compression molding, injection molding, and the like. For best results during the later plating step or steps, the molding apparatus which contacts the interpolymer should be as clean as possible. Platable compression molded articles can be formed, for example, by applying pressures of from about 40 to about 80 kg/cm$^2$ at temperatures of from about 180° C. to about 220° C. Platable injection molded articles can be formed at molding temperatures in the barrel of the machine of from about 165° C. to about 240° C. at pressures of from about 420 to about 1475 kg/cm$^2$, injection speeds of from about 0.3 to about 5.3 cm/sec., and a mold temperature of from about 76° to about 93° C.

Injection molding of the interpolymer substrate is the preferred way of forming the articles of the present invention in commercial practice since it is a rapid production technique capable of yielding shaped articles having a well-finished form of good dimensional accuracy and surface finish. Forms of relatively complex shape can be formed using this technique. The precise molding conditions should be selected in the ranges described above so that the shaped article can be plated with an adherent composite metal plating over substantially the entire surface area which is desired to be plated. Generally, for the best plating results, the molding temperature in the barrel of the apparatus should be selected so that it is in the upper portion of the above-described range so as to facilitate the melt flow of the interpolymer. As a general rule, a lower injection pressure and injection speed of the interpolymer will also aid in producing the best plating. The mold temperature should also be kept in the upper portion of the given range and the cooling period should be relatively long (e.g., 15–20 seconds) to reduce the potential for thermal stress in the formed article.

The shaped interpolymer substrate optionally containing filler, coupling agent, and/or impact modifier, can then be plated using conventional electroless plating procedures. This type of plating procedure generally comprises the steps of: (1) cleaning of the substrate; (2) etching of the substrate (3) neutralization of the etchant; (4) catalysis; (5) acceleration; and (6) electroless plating. Further details regarding these conventional procedures can be found in a number of prior art patents and publications including U.S. Pat. No. 3,667,972 to M. Coll-Palagos and "The ABC's of Electroplating ABS" in Plastics Engineering, January 1977, pp. 14–17.

The plastic substrate is first cleaned, if necessary, of any contaminants from earlier steps, such as oils, molding lubricants, and the like, by immersion of the substrate in a suitable cleaning solution, which is preferably a mild alkaline cleaner, such as a trisodium phosphate soda ash mixture.

After the optional cleaning step, the shaped plastic article is etched in order to give good metal-to-plastic adhesion in the later plating procedure. Preferably the etchant is a hot (for example, 50° C. to 75° C.) mixture of chromic acid, sulfuric acid, and water. Generally, the amount of water in such an etchant will range from about 40% to about 60%, by weight with the remainder being a mixture of chromic acid and sulfuric acid in a weight ratio of from about 1:1 to about 1.5:1. The interpolymer should be allowed to remain in the etchant solution for a sufficient length of time to satisfactorily etch the material (for example, from about 1 to about 5 minutes).

The neutralization step which generally follows the etching step comprises rinsing the etched plastic substrate with an aqueous solution to remove any of the adherent viscous etchant (e.g., chromic-sulfuric acid) solution which may remain. This step, for example, causes excess hexavalent chromium ions to desorb from the plastic and be reduced to the trivalent state which will not interfere with either the catalyst or nickel deposition steps to be described later. A variety of acidic and basic aqueous solutions are useful for this neutralization step.

The catalysis step follows and is needed to initiate the electroless metal deposition reaction on the non-conductive surface to the interpolymer. In this step, a metal salt which can be reduced in situ to provide metallic particles which can act as catalytic agents for the electroless plating reaction are applied to the interpolymer. Examples of such metal salts include silver nitrate or palladium chloride.

The acceleration step follows in which an acidic solution is used to activate the reduced metallic salt (e.g., palladium).

The electroless, or autocatalytic, plating step involves then treating the interpolymer with a suitable electroless plating solution containing a metal to be plated in ion form, a reducing agent, and, in an acidic bath, a buffer. Representative examples of metals include nickel, copper, and silver. Representative reducing agents include the alkali metal hypophosphites, borohydrides and formaldehyde. This plating step deposits a thin conductive metal film which can then be electroplated in a conventional manner, if desired, to form plated articles having a substantially continuous, composite metallic coating of up to about 70 microns over substantially all of their surface.

The following Examples illustrate certain preferred embodiments of the present invention.

EXAMPLE 1

This Example illustrates the general procedure that was used to plate the plastic substrates of Examples 2–3.

Each of the plastic substrates was first cleaned by immersion in an aqueous solution of a mild alkaline cleaner (ENTHONE PC-452), having a concentration of 40 gm. of cleaner to liter of solution, at 60° C. for about 5 min. After this cleaning procedure, the samples were then etched by placing them in an aqueous chromic acid/sulfuric acid bath containing about 28% by weight $CrO_3$ and 25% by weight $H_2SO_4$ for 3 minutes at 60° C. After removal from the etchant solution, the sample was placed for 45 seconds in an acidic 50 gm./liter neutralizer solution of bisulfate and flouride ions (Stauffer Acid Salts No. 5) held at room temperature (about 22° C.) to clean the pores left by the etchant solution.

The sample resulting from the prior steps was then treated at room temperature for 45 seconds with a hydrochloric acid solution containing palladium and tin salts (Shipley Catalyst 9F) to sensitize and catalyze the surface of the plastic. The stannate ions remaining on the surface were then removed by treating the sample with a 20%, by volume, acid aqueous solution (Shipley Accelerator S19) for 2 minutes at room temperature preparatory to the electroless nickel metal depositing step. This electroless nickel step was performed by treating the plastic sample for 6 minutes at 50° C. with an electroless nickel solution comprising the plating solution shown in Col. 8 of U.S. Pat. No. 3,667,972 which comprised: 42 gm./liter of nickel fluoborate; 100 gm./liter of sodium hypophosphite; 20 gm./liter of boric acid; 16 gm./liter of acetic acid; 14 gm./ liter of glycolic acid; 4 gm./liter of ammonium fluoride; 0.3 part per million parts of solution of thiourea; and 0.4 gm./liter of a nonionic surfactant wetting agent (VICTAWET-12).

A small portion of the plastic sample adjacent to one of its ends was then treated at room temperature for about 2 minutes with a parting agent which was a solution of 3 gm./liter of $K_2Cr_2O_7$ and 4.5 gm./liter of borax to initiate partial separation of portion of the plated layer for later peel strength measurement.

The electroless plated sample was then activated at room temperature with an aqueous solution of 10%, by weight, sulfuric acid and 1%, by weight, hydrochloric acid and was then electrolytically plated with copper at a cathode current density of 7 A/dm$^2$ at 24° C. in a bath containing the following composition for 30 minutes:

| Ingredient | Amount |
|---|---|
| Copper sulfate | 225 gm./liter |
| Sulfuric acid | 56 gm./liter |
| Chloride ion | 30 mg./liter |
| Plating additive (UBAC Make-up Plating Additive) | 0.75% (by wt.) |
| Plating addition (UBAC No. 1 Plating Additive) | 0.25% (by wt.) |

The sample was then plated with nickel electrolytically at 60° C. at a cathode current density of 15 A/dm$^2$ over a period of about 1.5 minutes using the following bath composition:

| Ingredient | Amount |
|---|---|
| Nickel sulfate | 50 gm./liter |
| Nickel chloride | 225 gm./liter |
| Boric acid | 50 gm./liter |

| Ingredient | Amount |
|---|---|
| Brightener (Udylite Brightener No. 610) | 1% by volume |
| Wetting agent (Udylite Wetting Agent No. 62) | 1% by volume |
| Brightener (Udylite Brightener No. 63) | 3% by volume |

The resulting product was then oven dried for 20 minutes at about 70° C. to allow the determination of peel strength measurements of the deposited metallic plating.

EXAMPLE 2

This Example illustrates the formation of a series of plated crosslinked (meth)acrylate/crosslinked styrene-acrylonitrile/uncrosslinked styrene-acrylonitrile articles using the general procedure of Example 1 having an adherent metal coating of from about 25 to about 40 microns.

The Table given below sets forth the ingredients which were mixed together (at about 180° C.) to form the filled plastic samples by compression molding which are then plated. The abbreviation "ASA" refers to the type of interpolymer shown and described in U.S. Pat. No. 3,944,631 to A. J. Yu et al. and comprised about 27.5%, by weight crosslinked polybutyl acrylate, about 10%, by weight, of a crosslinked styrene (73 wt.%)-acrylonitrile (27 wt.%) component, and about 62.5%, by weight, of an uncrosslinked styrene (73 wt. %)-acrylonitrile (27 wt. %) component. The abbreviation "SEI" refers to the crosslinked acrylate/polyvinyl chloride suspension-emulsion interpolymer described in U.S. Pat. No. 3,969,431 to R. E. Gallagher. The interpolymer comprised 50% to 54%, by weight, of an emulsion polymerized crosslinked polyacrylate component (70% polybutyl acrylate and 30% poly-2-ethylhexyl acrylate) and 50% to 46%, by weight, of a suspension polymerized polyvinyl chloride component. The silane treated fillers that are listed below were treated with 0.5% to 1%, by weight, of a silane coupling agent based on the weight of the filler.

All amounts given in the Table are in parts by weight unless otherwise stated.

TABLE 1

| | SAMPLE | | | | | | | | | | | | |
|---|---|---|---|---|---|---|---|---|---|---|---|---|---|
| Ingredient | A | B | C | D | E | F | G | H | I | J | K | L | M |
| ASA Resin | 300 | 300 | 300 | 300 | 300 | 300 | 300 | 300 | 270 | 270 | 270 | 270 | 270 |
| SEI Resin | — | — | — | — | — | — | — | — | 30 | 30 | 30 | 30 | 30 |
| Talc filler | 60 | — | — | — | — | — | — | 90 | — | — | — | — | — |
| Mica filler | — | — | 60 | — | — | 60 | — | — | 60 | — | 60 | — | — |
| Mica filler, silane treated | — | 50 | — | — | — | — | — | — | — | — | — | — | — |
| $CaCO_3$ filler, untreated | — | — | — | 60 | — | — | — | — | — | — | — | — | — |
| $CaCO_3$ filler, silane treated | — | — | — | — | 60 | — | 60 | — | — | 60 | — | 60 | — |
| $TiO_2$ filler | — | — | — | — | — | 9 | 9 | — | — | — | 9 | 9 | 9 |
| $CaCO_3$ filler, precipitated | — | — | — | — | — | — | — | — | — | — | — | — | 60 |

The adherence of the plated coating was tested on some of the specimens by a peel test in accordance with ASTM B 533-70. In this test an Instron tensometer was used to measure the tensile load, acting at about 90° to the plastic surface and at a constant rate, which will peel a strip of metal plating, having a certain defined width, from the substrate. The Table which follows gives the peel strengths that were recorded per unit width of the plated portion that was removed.

TABLE 2

| SAMPLE | PEEL STRENGTH (kg/cm) |
|---|---|
| B | 1.09 |
| C | 0.91 |
| D | 2.15 |
| E | 2.46 |
| F | 0.71 |
| G | 1.85 |
| H | 1.10 |
| J | 2.55 |
| L | 1.71 |

TABLE 2-continued

| SAMPLE | PEEL STRENGTH (kg/cm) |
|---|---|
| M | 1.96 |

Sample Nos. D and G were also tested after being exposed to three cycles of alternating high (85° C.) and low (−40° C.) temperatures in accordance with ASTM B 553-71, and the peel strengths were 1.85 and 1.66 kg./cm., respectively. Sample I was only tested after the heating procedure and showed a peel strength of 0.78 kg./cm.

EXAMPLE 3

This Example illustrates the formation of a series of plated, injection molded specimens using the plating procedure of Example 1 with the exception that: (a) the acid etching step was for a maximum of 2 minutes; (b) the soaking time with the hydrochloric acid solution (Shipley Catalyst 9F) was 45 seconds; and (c) the treatment with the parting agent was for 3 minutes. Run A used a commercially available, platable grade of an acrylonitrile - butadiene - styrene (ABS) resin. Run B used an unfilled acrylate/styrene/acrylonitrile interpolymer of the type shown in U.S. Pat. No. 3,944,631 to A. J. Yu et al. which comprised 29%, by weight, crosslinked polybutyl acrylate, 10.5%, by weight, crosslinked styrene-acrylonitrile (2.75:1 weight ratio of styrene to acrylonitrile), and 60.5%, by weight, of uncrosslinked styrene-acrylonitrile (2.29:1 weight ratio of styrene to acrylonitrile). Run C utilized the type of interpolymer of Run B in admixture of 3%, by weight of filled interpolymer, of a titanium dioxide filler. Run D utilized a material similar to Run C with the additional inclusion of 0.01%, by weight of filled interpolymer, of a carbon black filler as a second filler.

The materials of Run Nos. B-D were originally in powder form and were mixed at about 180° C. until homogeneous and were extruded to form pellets. These pellets were then used to form suitable injection molded specimens along with the ABS resin which was originally in pelletized form. The injection molding was performed using a mold temperature of 88° C. and the following conditions:

| Run | Feed Zone (°C.) | Front Zone (°C.) | Pressure (kg/cm$^2$) | Inj. Speed (cm/sec) |
|---|---|---|---|---|
| A* | 210 | 220 | 702 | 1.3 |
| B | 170 | 190 | 527 | 2.9 |
| C | 200 | 210 | 702 | 0.5 |
| D | 190 | 200 | 702 | 1.3 |

*not part of the invention

All samples were then tested for the peel adhesion of the coating in accordance with ASTM B 533-70 without any thermocycling treatment as described in ASTM B 553-71. The following results were obtained:

| Run | Peel Adhesion (kg/cm) |
|---|---|
| A* | 0.75 |
| B | 0.71 |
| C | 0.87 |
| D | 0.59 |

*not part of the invention

The foregoing Examples are merely illustrative of certain embodiments of the present invention and should not be construed in a limiting sense. The scope of protection that is sought is set forth in the claims which follow.

What is claimed:

1. A plated article which comprises:

(1) a substrate which comprises an interpolymer comprising crosslinked (meth)acrylate, crosslinked styrene-acrylonitrile, and uncrosslinked styrene-acrylonitrile components; and (2) an adherent metallic coating thereon over substantially an entire surface of the article.

2. An article as claimed in claim 1 wherein the substrate also comprises a filler material.

3. An article as claimed in claim 2 wherein the filler is selected from the group consisting of titanium dioxide, talc, mica, calcium carbonate, and carbon black.

4. An article as claimed in either claim 1, 2 or 3 wherein the interpolymer comprises from about 5% to about 50%, by weight, of the (meth)acrylate component, from about 5% to about 35% by weight, of the crosslinked styrene-acrylonitrile component, and from about 15% to about 90%, by weight, of the uncrosslinked styrene-acrylonitrile component.

5. An article as claimed in claim 1 which further comprises an impact modifier interpolymer comprising a crosslinked acrylate component and a vinyl chloride polymer component.

* * * * *